US005839871A

United States Patent [19]

Namgung

[11] Patent Number: 5,839,871

[45] Date of Patent: Nov. 24, 1998

[54] DOUBLE-PALLET PARKING GARAGE

[76] Inventor: Moon Hak Namgung, 409-25, Shipjung 2 dong, Bupyung-ku, Incheon, Rep. of Korea, 403-132

[21] Appl. No.: 856,094

[22] Filed: May 14, 1997

[51] Int. Cl.[6] ..... E04H 6/06

[52] U.S. Cl. ..... 414/228; 414/240

[58] Field of Search ..... 414/227–230, 414/234, 239, 240

[56] References Cited

U.S. PATENT DOCUMENTS

| | | | |
|---|---|---|---|
| 2,639,046 | 5/1953 | Tatosian | 414/234 |
| 2,858,032 | 10/1958 | Morley | 414/239 |
| 3,387,722 | 6/1968 | Fisher, Sr. et al. | 414/229 |
| 3,706,356 | 12/1972 | Herbst et al. | 414/228 X |
| 3,941,257 | 3/1976 | Matsuura | 414/229 X |
| 4,029,218 | 6/1977 | Matsuura | 414/240 |
| 5,035,562 | 7/1991 | Roser | 414/228 X |
| 5,158,413 | 10/1992 | Wu | 414/228 |
| 5,593,266 | 1/1997 | Wurzinger | 414/228 |

FOREIGN PATENT DOCUMENTS

| | | | |
|---|---|---|---|
| 0510316 | 10/1992 | European Pat. Off. | 414/228 |
| 148874 | 6/1981 | Germany | 414/234 |
| 422289 | 4/1967 | Switzerland | 414/240 |
| 999147 | 7/1965 | United Kingdom | 414/234 |
| 2243600 | 11/1991 | United Kingdom | 414/228 |
| 2255327 | 4/1992 | United Kingdom | 414/228 |

*Primary Examiner*—David A. Bucci
*Attorney, Agent, or Firm*—Dougherty & Dremann

[57] ABSTRACT

A double-pallet parking garage for automobiles is disclosed. A ground pallet is carried on a pair of parallel base frames to be horizontally movable between the entrance and parking positions thereof. Guide and support columns stand on both ends of each base frame. The liftable pallet moves between the entrance and parking positions thereof in accordance with the turning motion of a pair of turning links. The liftable pallet is movably held by the upper ends of the turning links and moves between the entrance and parking positions while remaining horizontal. The liftable pallet moves vertically under the guide of the guide column and moves along an arcuate trace under the guide of an arcuate guide beam. The double-pallet parking garage of this invention does not cause any interference between the liftable and ground pallets during movement of the pallets.

5 Claims, 5 Drawing Sheets

DOUBLE-PALLET PARKING GARAGE

FIELD OF THE INVENTION

The present invention relates in general to parking garages for automobiles and similar vehicles and, more particularly, to a structural improvement in a double-pallet parking garage for not only parking two automobiles on the upper and lower pallets of the garage at the same time but also for allowing an automobile to enter onto or exit from the upper pallet without causing any interference between the upper pallet and an automobile of the lower pallet.

BACKGROUND

In order to park many automobiles in a limited parking place of, for example, an office building, it has been necessary to provide stacked parking spaces in the air above ground in the parking place. A dwelling house has been preferably provided with a double-pallet parking garage for parking at least two automobiles stacked in a limited parking place which otherwise might just accommodate one automobile. The double-pallet parking garage thus improves the spatial efficiency of a limited parking place of an office or residential building.

Several types of double-pallet parking garages suitable for parking two automobiles on the upper and lower pallets thereof at the same time have been proposed and used. In most of the typical double-pallet parking garages, a pair of liftable pallets are mounted to the moving part of a turning link which is simply turned by the traction power of a cylinder or rope. In the above double-pallet parking garages, the pallets move between the exit and parking positions by the turning motion of the link. The exit position of each pallet is leveled with the ground surface, while the parking position of the second pallet is in the air. In the above double-pallet parking garages, the pallets mounted to the turning link turn along an arcuate trace to reach the exit or parking position. When the turning trace of the pallets has a short radius, the upper pallet may cause an interference with a top corner of the lower pallet during the turning motion of the pallets and thereby cause damage to the automobile of the lower pallet. Therefore, the radius of the turning trace of the pallets in the typical double-pallet parking garages must be substantially long enough to prevent any damage of the automobile on the lower pallet. However, the lengthened radius of the turning trace of the pallets regrettably enlarges the vertical and horizontal sizes of the double-pallet parking garage.

SUMMARY OF THE INVENTION

It is, therefore, an object of the present invention to provide a double-pallet parking garage in which the above problems can be overcome and which reduces the required area of the parking place and thereby reduces the space for installing the parking garage.

In order to accomplish the above object, a double-pallet parking garage for automobiles in accordance with a preferred embodiment of this invention includes a pair of parallel base frames that are horizontally installed on the ground and spaced out at an interval. A ground pallet is carried on the base frames to be horizontally movable on the ground between the entrance and parking positions thereof. This ground pallet is operated by a first actuating cylinder. A guide column stands on one end of each base frame, while a support column stands on the other end of each base frame. The garage also includes first and second turning links adapted for moving a liftable pallet between the entrance position on the ground and the parking position in the air above the ground pallet in the parking position. Lower ends of the links are pivotally mounted to each base frame with an interval between the two links, while the upper ends of the links are connected together by a connection link. The turning links are turned by a second actuating cylinder. The liftable pallet is movably mounted to and held by the upper ends of the turning links to move between the entrance and parking positions while remaining horizontal in accordance with a turning motion of the turning links. The liftable pallet moves vertically under the guide of the guide column and moves along an arcuate trace. In the above parking garage, two automobiles are parked on the ground and liftable pallets, respectively.

The liftable pallet moves vertically under the guide of the guide column and moves along the arcuate trace under the guide of the arcuate guide beam in accordance with a turning motion of the turning links, thus moving between the exit position on the ground and the parking position in the air. On the other hand, the ground pallet horizontally moves under the guide of the base frames to move between the exit position, which is equal to that of the liftable pallet, and the parking position under the parking position of the liftable pallet.

In the double-pallet parking garage of this invention, the liftable pallet linearly moves in a vertical direction except for a limited section where the liftable pallet moves along a curved trace. In this regard, the liftable pallet does not cause any interference between the liftable pallet and any top corner of a ground pallet during the movement of the liftable pallet. The above parking garage can thus reduce the required space for installing the garage and reduces the area of the parking place. In addition, when the parking garage of this invention is installed on a roadside, the entrance or exit ramp of the ground or liftable pallet is directed in parallel to the road, so that an automobile can directly enter from the road onto either pallet or exit from either pallet onto the road. The parking garage of this invention is thus convenient to users.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
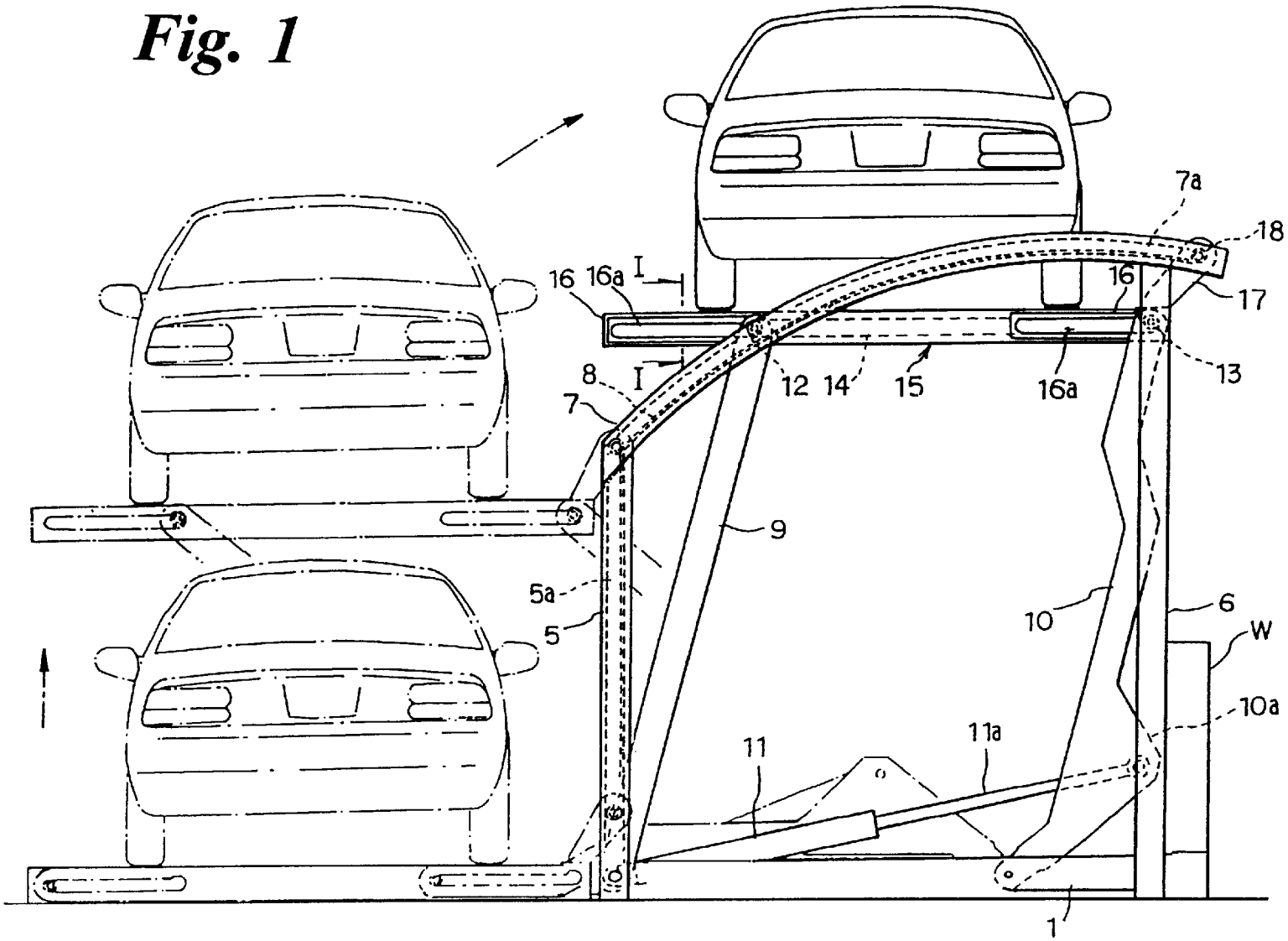
FIG. 1 is a front view of a double-pallet parking garage in accordance with a preferred embodiment of the present invention.

The double-pallet parking garage according to the present invention has a symmetric construction, so that only the parts on one side of the parking garage will be shown in the drawings and described in the following description. In addition, for ease of description, the end of the garage on the left-hand side of the drawings will be referred to as the forward end of the garage and the opposite end on the right-hand side of the drawings will be referred to as the rear end.

Figure 2:
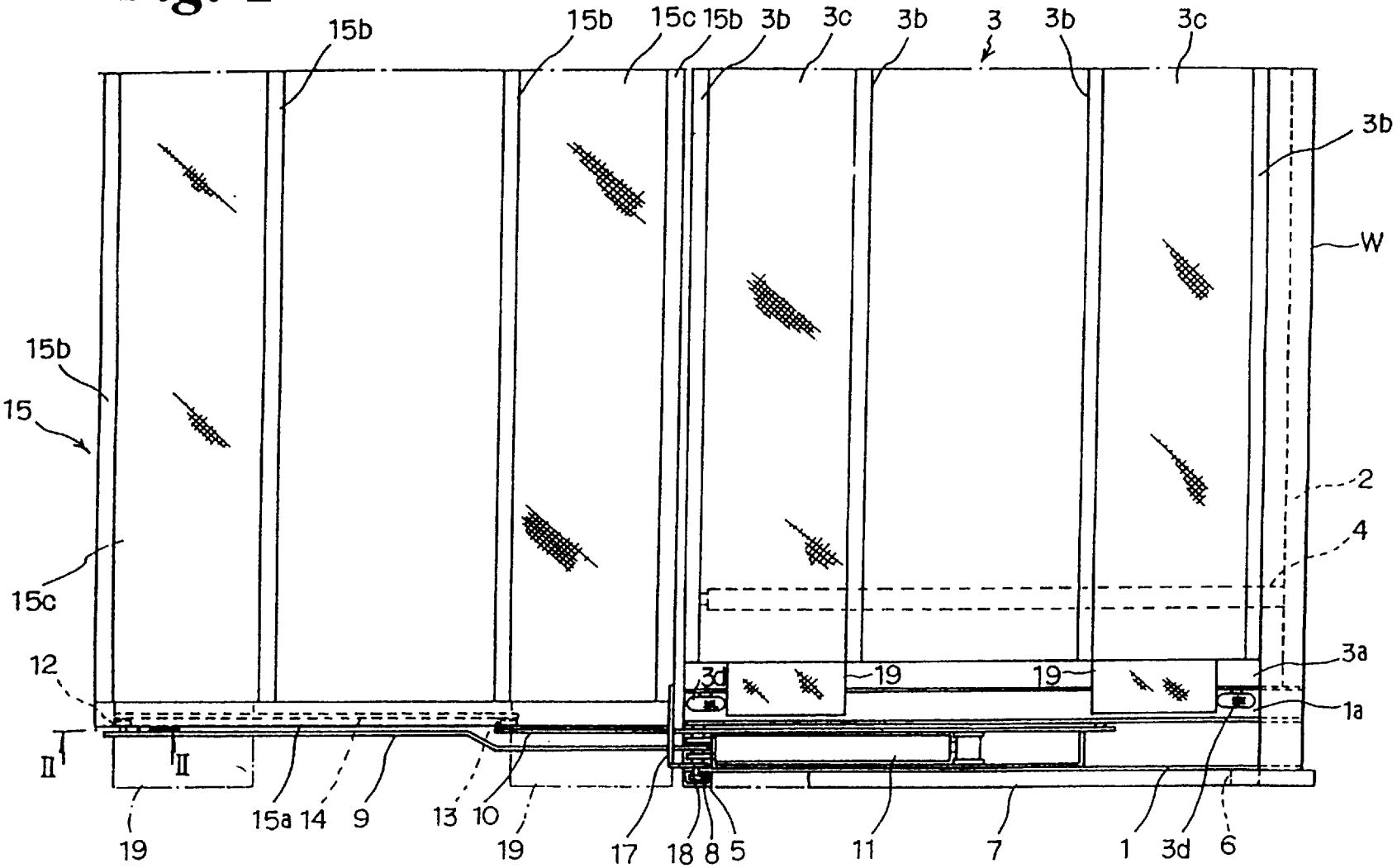
FIG. 2 is a plan view of the parking garage of FIG. 1.

FIGS. 1 and 2 are front and plan views of the double-pallet parking garage in accordance with a preferred embodiment of this invention, respectively. In the drawings, the reference numeral 1 denotes a pair of parallel base frames which are horizontally installed on the ground to transversely extend in the garage. A rail 1*a* extends in parallel with each base frame 1 inside the frame 1. The above base frames 1 are connected together by a longitudinal connection bar 2. A ground pallet 3 is movably carried on the above base frames 1 in a way such that the pallet 3 can horizontally slide on the frames 1. In the above ground pallet 3, a pair of spaced transverse beams 3*a* are connected together by a plurality of longitudinal beams 3*b*, thus defining a plurality of rectangular spaces inside the beams 3*a* and 3*b*. Mounted to the rectangular spaces defined by the beams 3*a* and 3*b* are a plurality of holding panels 3*c*. Both ends of each transverse beam 3*a* in the above ground pallet 3 are provided with rollers 3*d*. The rollers 3*d* are movably carried on the rail 1*a* of the base frame 1, so that the rollers 3*d* roll on the rail 1*a* to horizontally move the pallet 3 between the exit and parking positions. The horizontal movement of the above ground pallet 3 along the rail 1*a* is performed by a first actuating cylinder 4. The cylinder 4 is installed under the pallet 3.

The reference numeral 5 denotes a guide column that vertically stands on the forward end of each base frame 1, while the reference numeral 6 denotes a support column that vertically stands on the rear end of each base frame 1. The support column 6 is slightly higher than the guide column 5. An arcuate guide beam 7 is connected to the tops of the guide and support columns 5 and 6. Both the guide column 5 and the guide beam 7 have an angled U-shaped cross-section, forming a guide channel 5*a*, 7*a*. The guide channels 5*a* and 7*a* in the guide column and beam 5 and 7 communicate with each other. A fixed chain 8 is provided in each channel 5*a*, 7*a*.

The parking garage of this invention also includes first and second turning links 9 and 10 whose lower ends are pivotally mounted to the forward end and rear portion of each base frame 1, respectively. The lower portion of the second link 10 defines a protruding bracket 10*a* which has a generally triangular configuration. Pivotally mounted to the above bracket 10*a* is the actuating rod 11*a* of a second actuating cylinder 11. The other end of the above cylinder 11 is pivotally mounted to the forward end of each base frame 1. The upper ends of the links 9 and 10 are provided with the respective rollers 12 and 13 and are connected together by a connection link 14.

Figure 3:
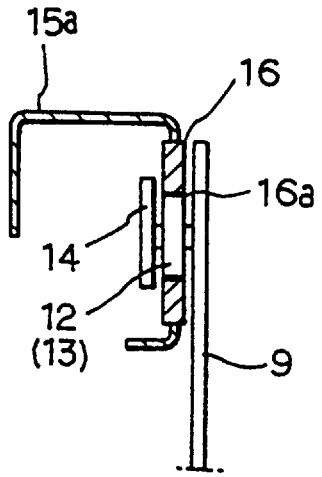
FIG. 3 is a sectional view taken along the line I—I of FIG. 1, showing the engagement between a guide panel and a roller of a turning link.
Figure 4:
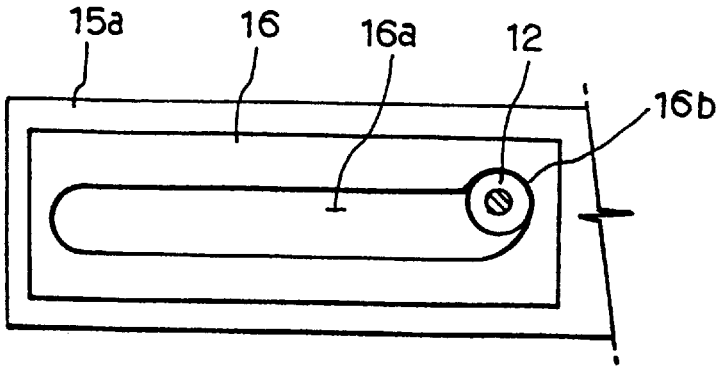
FIG. 4 is a sectional view taken along the line II—II of FIG. 2, showing the construction of the guide panel engaging with the roller.

The reference numeral 15 denotes a liftable pallet which can move between the exit and parking positions. The exit or entrance position of the above pallet 15 is leveled with the ground on a side of the parking garage, while the parking position of the pallet 15 is in the air above the ground pallet 3 in the parking position. In the above liftable pallet 15, a pair of spaced transverse beams 15*a* are connected together by a plurality of longitudinal beams 15*b*, thus defining a plurality of rectangular spaces inside the beams 15*a* and 15*b*. A plurality of holding panels 15*c* are mounted to the rectangular spaces defined by the beams 15*a* and 15*b*. Mounted to both ends of each transverse beam 15*a* are guide panels 16. Each guide panel 16 is provided with a longitudinal guide opening 16*a* whose rear end terminates in a stop opening 16*b* as shown in FIG. 4. The width of the stop opening 16*b* is slightly larger than that of the guide opening 16*a*. The guide openings 16*a* in the guide panels 16 movably receive the rollers 12 and 13 of the links 9 and 10, respectively, as best seen in FIG. 3. Fixed to the rear end of each transverse beam 15*a* in the liftable pallet 15 is a bracket 17. The other end of each bracket 17 is provided with a sprocket wheel 18 which engages with the chains 8 in the channels 5*a* and 7*a*. The bracket 17 thus moves along the guide beam 7 and guide column 5 under the guide of the chains 8.

In the drawings, the reference numeral 19 denotes an exit or entrance ramp panel which is mounted to the entrance edge in each pallet 3, 15. The above ramp panel 19 is inclined downward at an angle of inclination to allow an automobile to smoothly enter onto or exit from each pallet 3, 15.

The operational effect of the above parking garage will be described hereinbelow.

In order to park an automobile on the liftable pallet 15, the pallet 15 must be placed in the entrance or exit position on the ground on a side of the garage as shown in the phantom line of FIG. 1. The automobile enters onto the liftable pallet 15 in the above state. Thereafter, the second actuating cylinder 11 is operated to extend the actuating rod 11*a*, so that the turning links 9 and 10 are turned clockwise as shown in the phantom line of FIG. 1. During the clockwise turning motion of the links 9 and 10, the parallelism between the links 9 and 10 is continuously maintained. While the links 9 and 10 are turned clockwise as described above, the rollers 12 and 13 of the links 9 and 10 slide inside the guide openings 16*a* of the liftable pallet 15. In the above state, the sprocket wheel 18 of the bracket 17 moves upward along the fixed chain 8 of the guide column 5. The liftable pallet 15 thus vertically moves upward along the guide column 5 while remaining horizontal until the pallet 15 reaches the top end of the guide column 5. When the pallet 15 has reached the top end of the guide column 5, the rollers 12 and 13 of the links 9 and 10 are stopped by the stop openings 16*b* inside the guide panels 16. When the links 9 and 10 in the above state are further turned clockwise, the sprocket wheel 18 of the pallet 15 moves along the fixed chain 8 inside the guide beam 7. The liftable pallet 15 thus reaches the parking position above the ground pallet 3 in the parking position without causing any interference between the pallets 3 and 15. When the liftable pallet 15 has reached the parking position, the second actuating cylinder 11 is automatically stopped by a control means (not shown), thus stopping the pallet 15 with the automobile on the parking position.

While the liftable pallet 15 vertically moves on a side of the garage under the guide of the guide column 5, the turning links 9 and 10 extremely lean to the forward side as shown in the phantom line of FIG. 1. The links 9 and 10 in the above state apply turning moments to the base frames 1, so that the parking garage may be tilted to the forward side. However, the parking garage of this invention is provided with a weight W on the connection bar 2, so that the parking garage is prevented from being tilted irrespective of the turning moments applied to the base frames 1 by the leaning links 9 and 10.

In order to allow the automobile to exit from the liftable pallet 15, the cylinder 11 is operated to retract the actuating rod 11*a*. The pallet 15 in the above state is shifted in a reverse manner thereby reaching the entrance or exit position on the ground. The automobile thus can exit from the pallet 15 in the above exit position.

In the double-pallet parking garage of this invention, the ground pallet 3 can move between the entrance and parking positions without causing any interference between the two pallets 3 and 15. While the pallet 3 moves between the entrance and parking positions, the liftable pallet 15 is maintained on the parking position. The ground pallet 3 in the parking position is placed under the liftable pallet 15 in the parking position, while the pallet 3 in the exit position is placed on the exit position of the liftable pallet 15. The ground pallet 3 moves between the parking and exit positions as follows.

Figure 5:
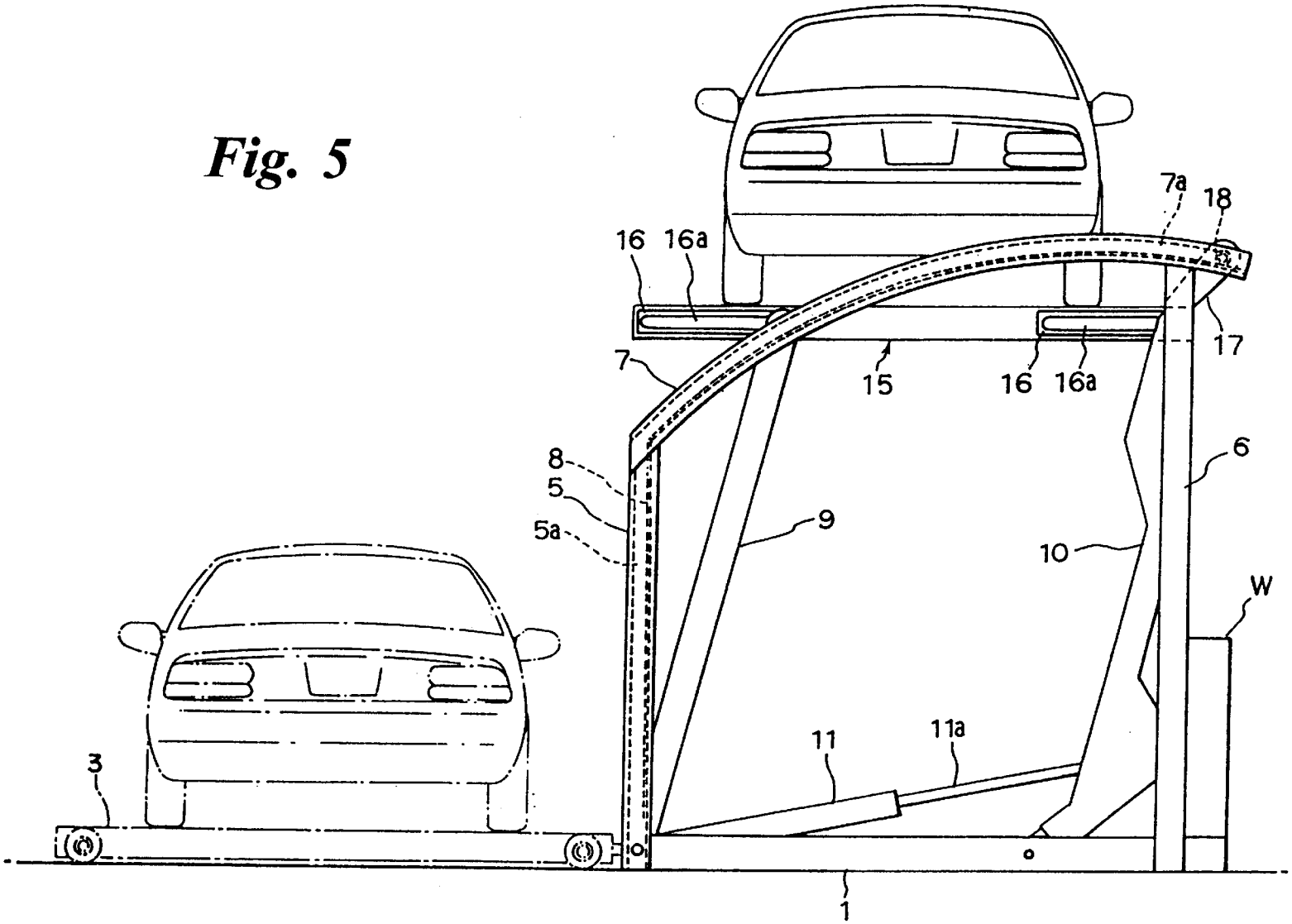
FIG. 5 is a front view showing a ground pallet of the parking garage of FIG. 1 in the exit position.

In order to move the pallet 3 from the parking position toward the exit position, the first actuating cylinder 4 is operated to extend the actuating rod (not shown). The rollers 3*d* of the pallet 3 move forward in the drawings along the rails 1*a* of the base frames 1, thus reaching the exit position. The exit position of the ground pallets 3 is equal to that of the liftable pallet 15 as shown in the phantom line of FIG. 5. When the ground pallet 3 has reached the exit position, the cylinder 4 is automatically stopped by the control means (not shown) and thereby stops the pallet 3 in the exit position. An automobile can enter onto or exit from the ground pallet 3 in the above state. In order to return the ground pallet 3 with the automobile from the exit position toward the parking position, the cylinder 4 is operated to retract the rod 4*a* thus moving the pallet 3 in a reverse manner until the pallet 3 reaches the parking position.

When the rails 1*a* of the base frames 1 extend to cover the exit position of the ground pallet 3, it is possible to more smoothly move the pallet 3 between the exit and parking positions.

Figure 6:
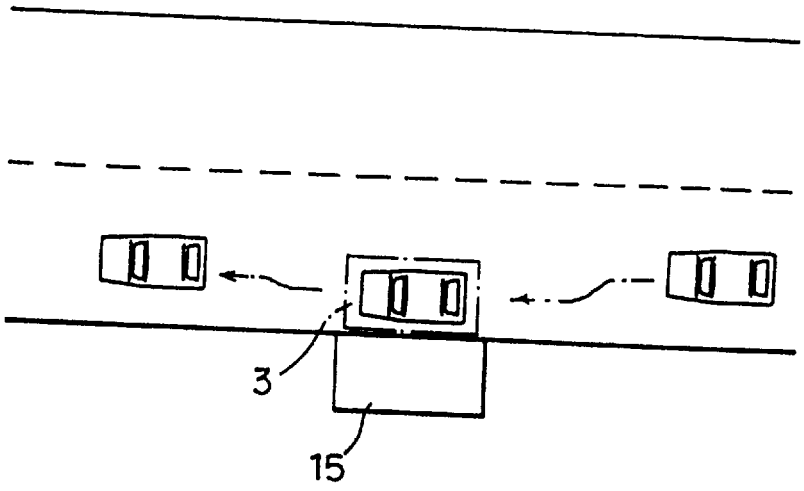
FIG. 6 is a plan view showing the parking garage of this invention installed on a roadside.

As described above, the double-pallet parking garage according to this invention is provided with a liftable pallet which linearly moves in a vertical direction except for a limited section where the liftable pallet moves along a curved trace. In this regard, there is no interference between the liftable pallet and any top corner of a ground pallet during movement of the liftable pallet. The parking garage can thus reduce the required space for installing the garage and reduces the area of the parking place. In addition, when the parking garage of this invention is installed on a roadside as shown in FIG. 6, the entrance or exit ramp of the ground or liftable pallet is directed in parallel to the road, so that an automobile can directly enter from the road onto either pallet or exit from either pallet onto the road. The parking garage of this invention is thus convenient to users.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

I claim:

1. A double-pallet parking apparatus for automobiles in a parking garage, comprising:

a pair of base frames having opposed ends and oriented generally horizontal to a ground surface of the parking garage, said base frames being spaced apart and substantially parallel to one another;

a ground pallet horizontally slidable on said base frames;

a first actuating cylinder for moving said ground pallet between an entrance position and a lower parking position;

a pair of generally parallel guide columns fixedly positioned proximate to the first ends of said base frames;

a pair of generally parallel support columns fixedly positioned proximate to the second ends of said base frames;

a first pair of turning links having lower ends pivotally mounted to the first ends of said base frames;

a second pair of turning links having lower ends pivotally mounted to the second ends of said base frames;

a liftable platform positioned on upper ends of said turning links; and a second actuating cylinder for operating said second pair of turning links;

wherein a turning motion of said turning links moves said liftable pallet between the entrance position and the upper parking position; and wherein the liftable pallet are moveable in a generally arcuate path between said guide columns and said support columns and is moveable in a generally vertical path along said guide columns thereby significantly reducing the operating area of the parking apparatus.

2. The double-pallet parking apparatus of claim 1 wherein said support columns are longer than said guide columns.

3. The double-pallet parking apparatus of claim 1 further comprising a pair of arcuate guide beams extending between upper ends of said guide columns and upper ends of said support columns and wherein said arcuate guide beams guide said second pair of turning links.

4. The double-pallet parking apparatus of claim 3 wherein said arcuate guide beams and said guide columns have channels formed therein, wherein said guide beam channels and said guide column channels are in communication with each other and wherein a first roller extending through said first pair of links and a second roller extending through said second pair of links are moveable in said channels.

5. The double-pallet parking apparatus of claim 4 further comprising a connection link positioned between said first roller and said second roller.

* * * * *